US005722923A

United States Patent [19]

Lui

[11] Patent Number: 5,722,923

[45] Date of Patent: Mar. 3, 1998

[54] DEVICE FOR ABDOMINAL MUSCLE EXERCISE

[76] Inventor: Herman Lui, 329, W. 29th St., Apt. 405, New York, N.Y. 10001

[21] Appl. No.: 512,622

[22] Filed: Aug. 8, 1995

[51] Int. Cl.[6] ..... A63B 26/00

[52] U.S. Cl. ..... 482/140; 482/142; 482/907

[58] Field of Search ..... 482/140, 142, 482/131, 907, 145; 606/242, 243, 244, 245

[56] References Cited

U.S. PATENT DOCUMENTS

| | | | |
|---|---|---|---|
| 2,264,046 | 11/1941 | McClellan | 482/140 |
| 2,475,003 | 7/1949 | Black | 606/242 |
| 3,771,518 | 11/1973 | Greissing | 606/243 |
| 4,347,840 | 9/1982 | Adams | 606/242 |
| 4,520,800 | 6/1985 | Kowalski | 606/243 |
| 4,582,319 | 4/1986 | Luna | 482/140 |
| 4,650,187 | 3/1987 | Chenera | 482/140 |
| 4,752,067 | 6/1988 | Colonello . | |
| 4,856,497 | 8/1989 | Westphal | 606/242 |
| 5,120,052 | 6/1992 | Evans . | |

*Primary Examiner*—Lynne A. Reichard

*Attorney, Agent, or Firm*—Burns, Doane, Swecker & Mathis

[57] ABSTRACT

An exercise device primarily for performing the so-called sit-up exercise is provided with a pivotably adjustable back-rest and a longitudinally adjustable hip-rest. The combined adjustability of the back- and hip-rests gives proper support to the back of a user during exercise and minimize the risk of back injuries notwithstanding that the spine sizes of different individuals depend on their physical particulars.

10 Claims, 12 Drawing Sheets

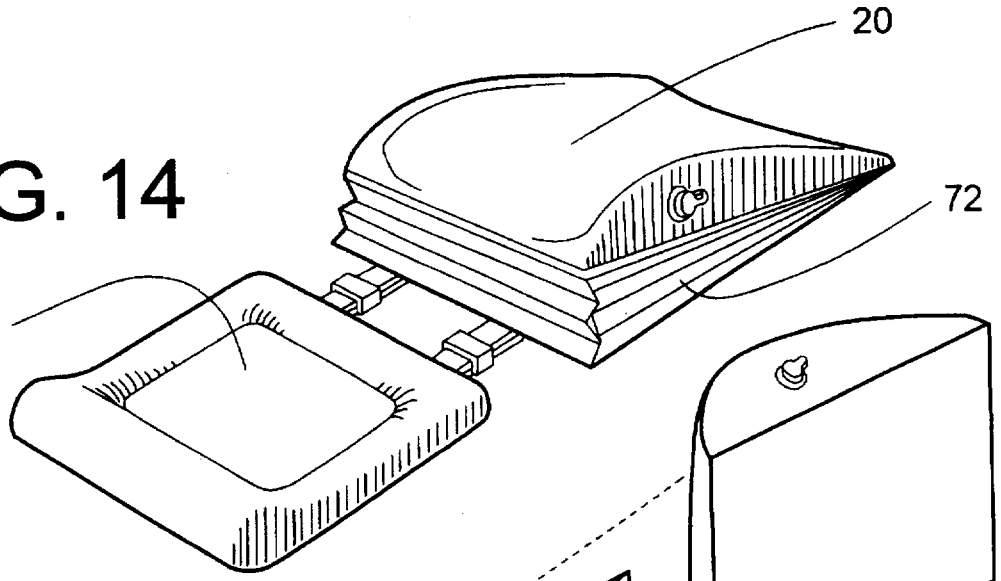
FIG. 14
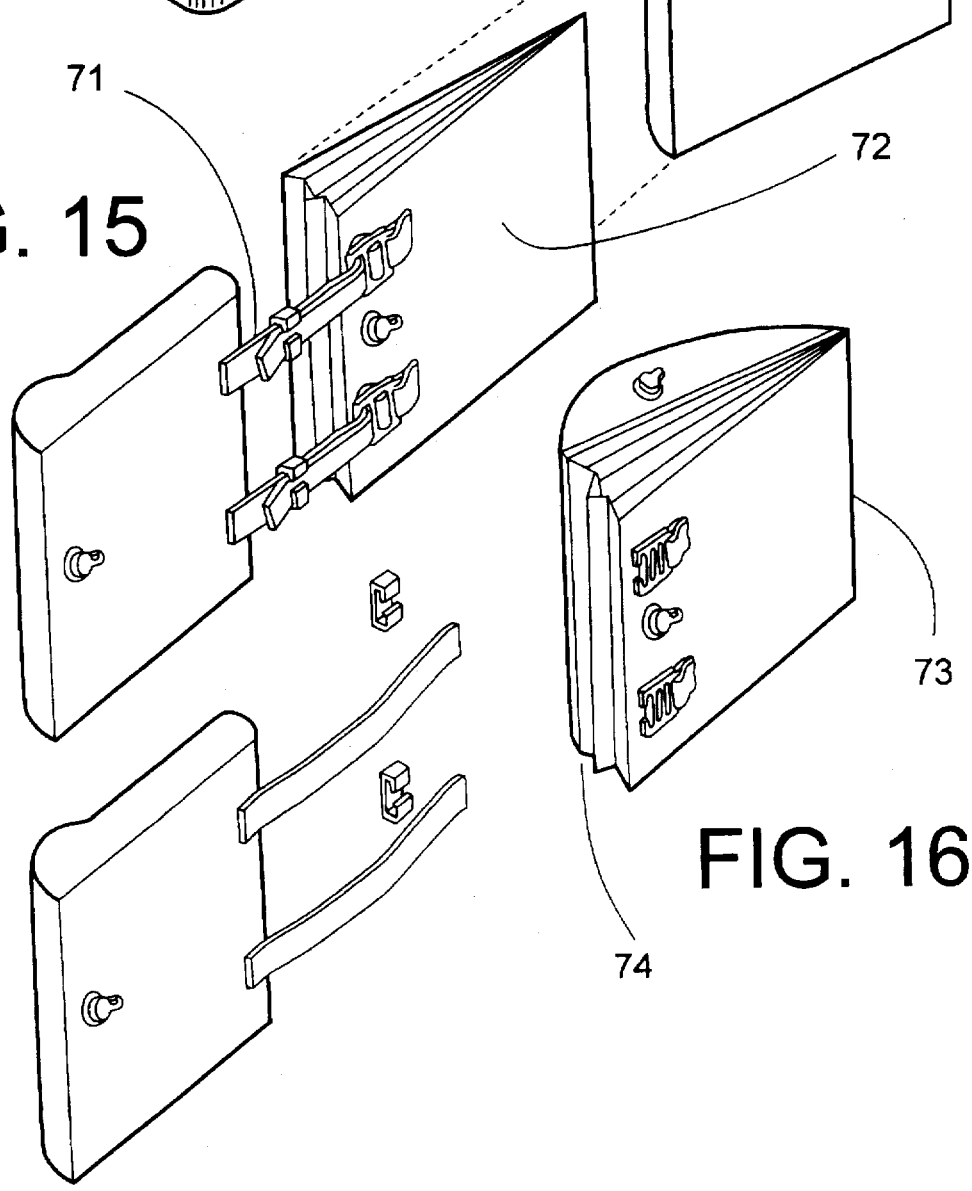
FIG. 15
FIG. 16

DEVICE FOR ABDOMINAL MUSCLE EXERCISE

TECHNICAL FIELD

The present invention relates to an exercise device, in particular, to a device for use in performing abdominal muscle exercises.

BACKGROUND OF THE INVENTION AND PRIOR ART

Abdominal muscle exercises are very popular since they have long been regarded as the best way to keep abdominal muscles in good shape and tone. More importantly, such exercises are known to be an effective and healthy way to avoid deposition of bulky fat around the waist line which fat would then appear unpleasantly as protruding bellies, a sign most health and aesthetic conscious people would try to hide or avoid.

Among the many types of abdominal muscle exercises, the so-called "sit-up" is probably the most widely performed because it is simple, easy and effective. In performing a conventional sit-up exercise, a person lies with his back flat on the floor, face up, knees bent, feet flat and secured on the floor and hands behind the head with fingers interlocked. The person then exercises the abdominal muscles in order to cause pivotal movement of his trunk about his hip and towards the bent knees. After the trunk is brought into a substantially vertical position, the person returns to the initial start-up posture by controlling the abdominal muscles and completes a cycle of the exercise.

During the exercise, and especially the initiation and completion of each exercise cycle, the spine is under very large compressional stress. To achieve and maintain a good muscle shape and condition, it is generally agreed that the exercise should be performed persistently and regularly and, indeed, performance of the exercise for a few hundred times per day is certainly not unusual for many enthusiasts. The stressful nature of this exercise together with the high performance frequency has always been the concern of many health experts who have been giving constant warnings of possible back damages or chronic injuries if the exercise is not properly performed.

U.S. Pat No. 4,752,067 discloses a moulded sit-up exercise device which is designed to reduce the stress on the lower back by providing a lumbar support which extends integrally from a basin in which the hips of the user rest. Such a device was a step forward from conventional device but the moulded nature of the device means its application presupposes a one-sized human body. In reality, the size and shape of the back of a human body, though grossly similar, depend on the age, gender, race, and other facts. Reliance on the device as an universal exercise aid might cause un-aware harm.

U.S. Pat. No. 5,120,052 discloses a sit-up exercise device which has a non-symmetrical upward arch on which the entire back of a user lies. When a person lies naturally and supinely on the arch, the entire back is supported by the arch and bent according to the shape of the arch with the lumbar spine located directly above the vertex of the arch. During the initiation and completion of the exercise and aggravated by the extra bend, the lumbar spine is under enormous compressional stress and the spine is therefore prone to injuries if the arch does not fit properly under the back.

It is therefore an object of the present invention to provide an exercise device which mitigates the problems associated known devices by providing parts which can be adjusted according to the physical particulars of the person utilising the device. It is a further object of the present invention to provide such a device which can be easily and conveniently used.

SUMMARY OF THE INVENTION

According to the present invention, there is provided an exercise device comprising a housing, a hip-rest and a back-rest. The housing of the present device comprises a first and a second end and accommodates the hip- and back-rests. The back-rest is for supporting the back of a user during the initiation and completion of exercise and comprises an upward arch which is pivotably movable about the first end of the housing. The hip-rest is for receiving the hips of the user during the exercise and comprises a front and a rear edge wherein the longitudinal distance between said front edge of the hip-rest and the first end of the housing is adjustable.

Preferably the arch of said back-rest comprises a first and a second slope wherein the first slope is shorter and steeper than the second slope, the second slope faces the first end of the housing and the lower end of the second slope descends substantially to the ground level such that, in combination with the longitudal position adjustment of said hip-rest, the shoulders of the user are practically resting on the ground level.

Preferably the housing comprises an upper and a lower housing wherein the hip-rest and the back-rest are mounted on the upper housing while the feet-rest located in the lower housing such that the feet-rest is provided with means for receiving and restraining the feet of the user.

Preferably the exercise device further comprises a raised barrier formed at the front edge of the hip-rest for restraining the hips of the user. Preferably the lower housing of the said housing is retractable within the said upper housing.

BRIEF DESCRIPTION OF THE DRAWINGS

The present invention will now be described, by way of examples and with reference to the accompanying drawings, in which:

FIG. 14 shows the top perspective view of a second embodiment of the present invention;

FIG. 15 shows the partly exploded view of the device of FIG. 14;

FIG. 16 shows a further exploded view of the device of FIG. 14;

DETAILED DESCRIPTIONS OF THE PREFERRED EMBODIMENTS

Figure 1:
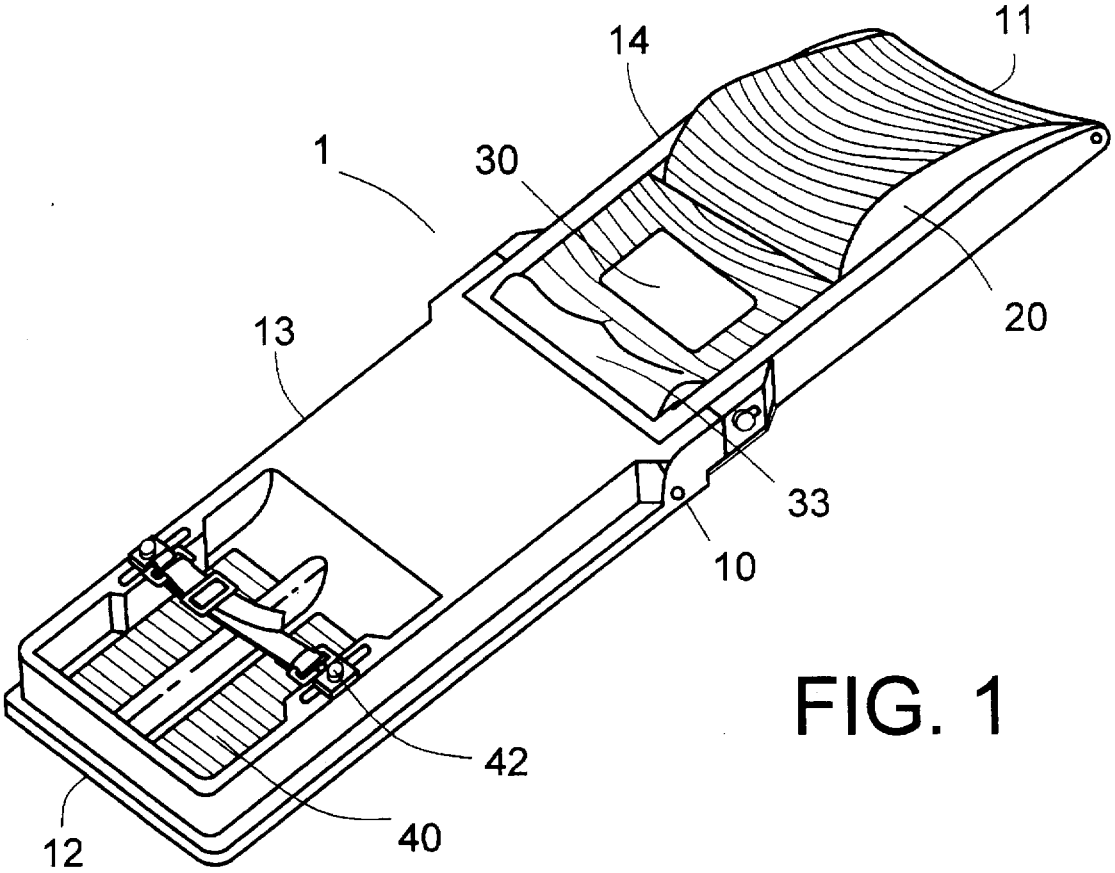
FIG. 1 shows the top perspective view of a first preferred embodiment of an exercise device of the present invention.
Figure 2:
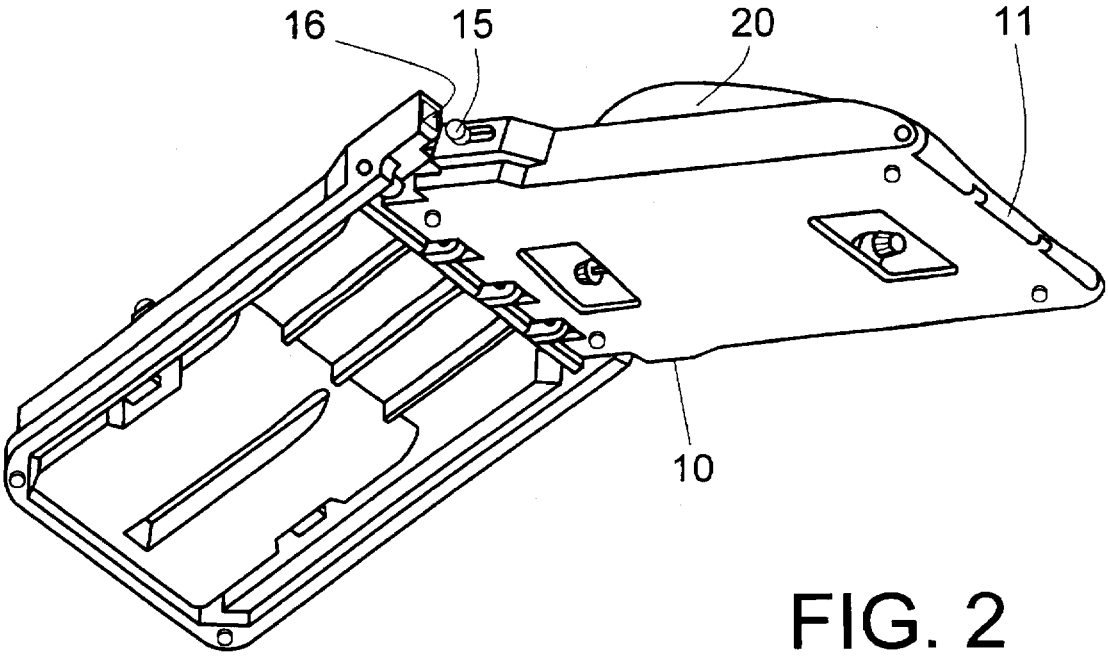
FIG. 2 is the bottom perspective view of the device of FIG. 1 when the device is being folded into a back to back configuration.

To assist in the understanding of the present invention, there is shown in FIGS. 1–8 a first embodiment of an exercise device of the present invention. Referring to the figures, the exercise device 1 comprises a main housing 10 on which a back-rest 20, a hip-rest 30 and a feet-rest 40 are provided.

Figure 3:
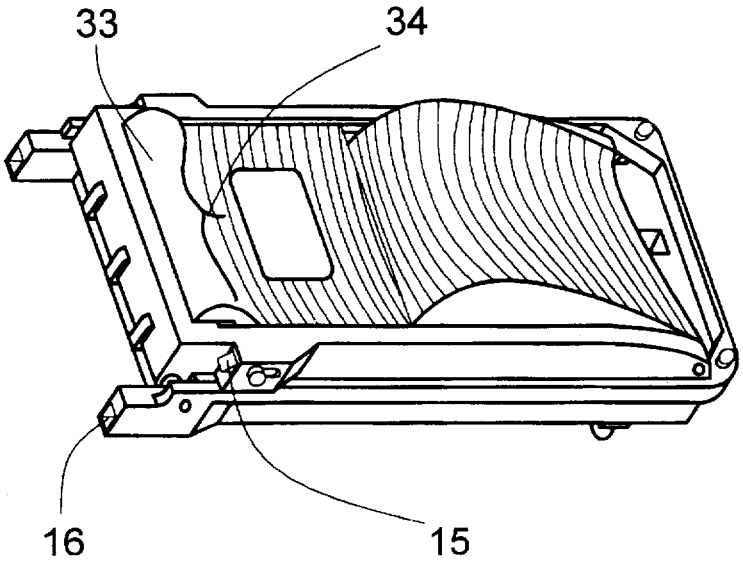
FIG. 3 is the top perspective view of the device of FIG. 1 when the device has been completely folded into a back to back configuration.
Figure 4:
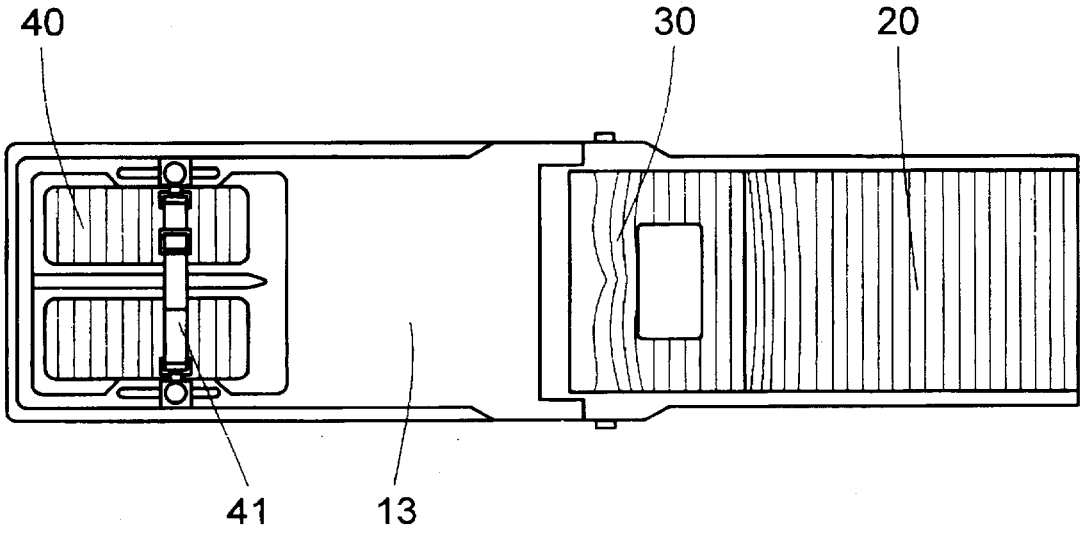
FIG. 4 shows the top view of the device of FIG. 1.
Figure 5:
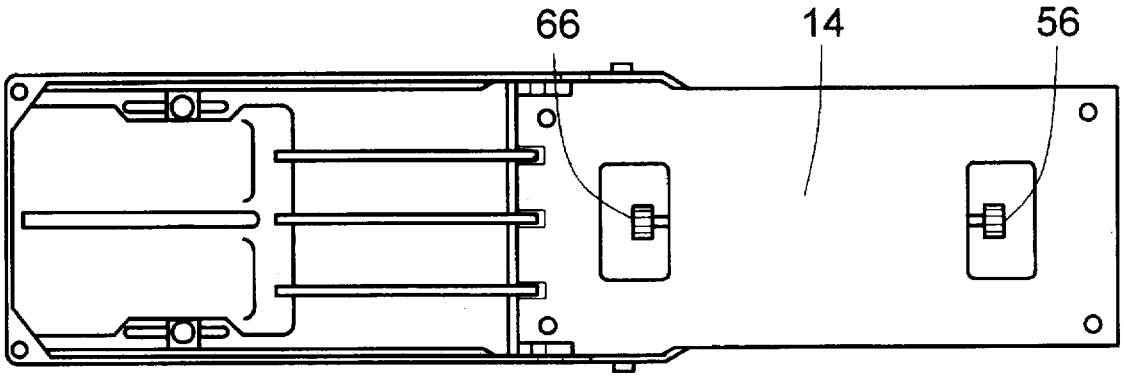
FIG. 5 shows the bottom view of the device of FIG. 1.
Figure 6:
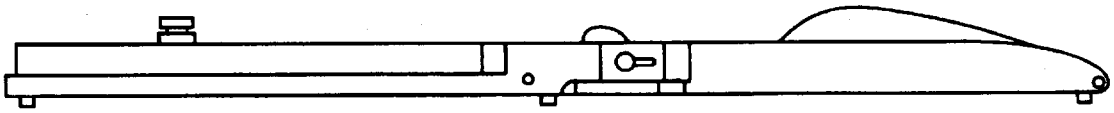
FIG. 6 shows a side view of the device of FIG. 1.
Figure 7:
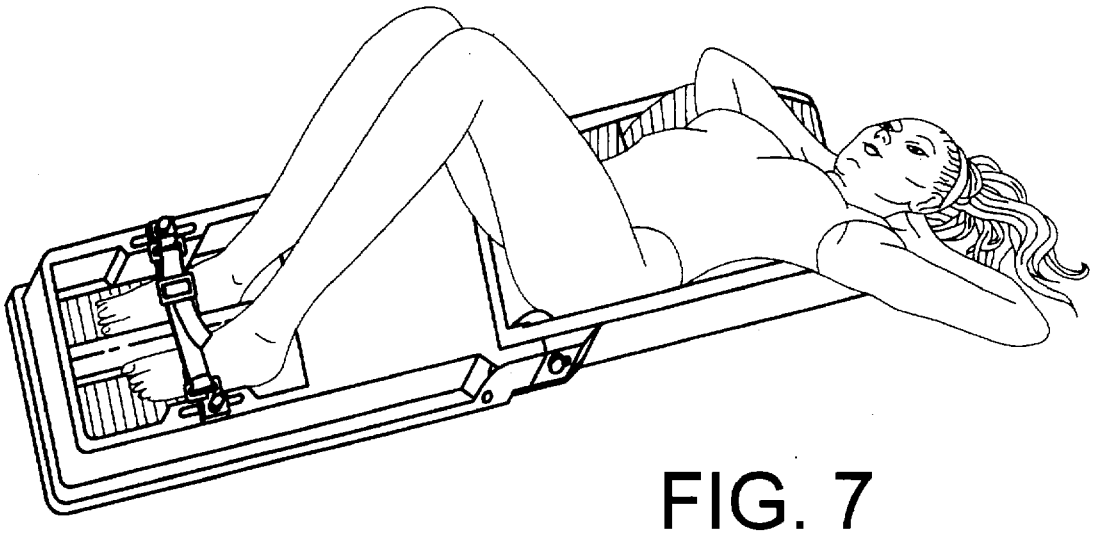
FIG. 7 is an illustration showing a person using the device in the initial and completion positions.
Figure 8:
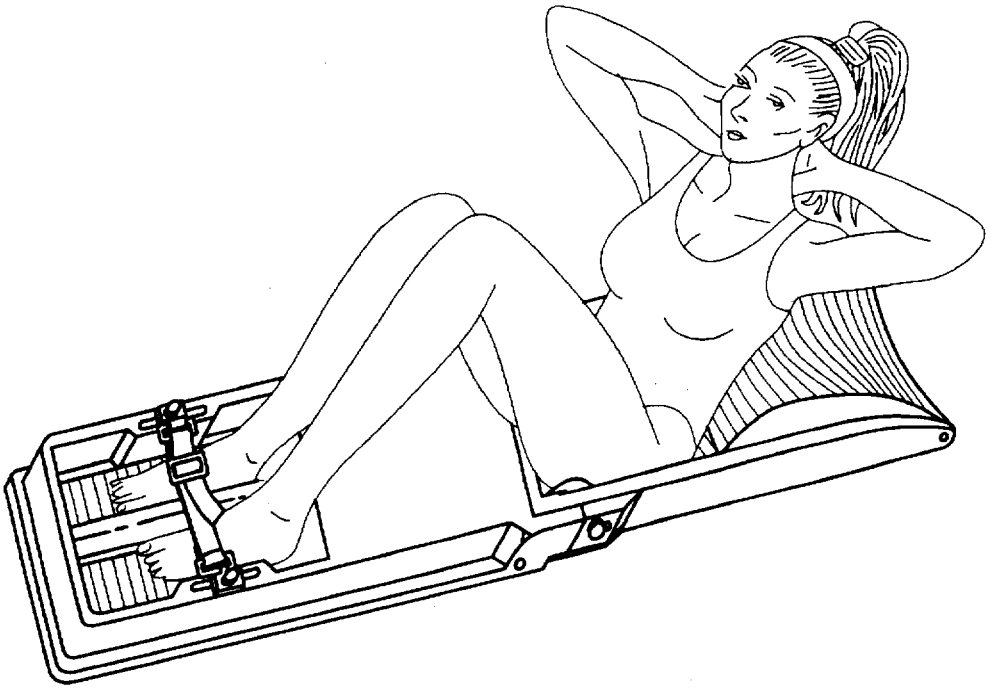
FIG. 8 is an illustration showing the person in an intermediate exercise position.
Figure 9:
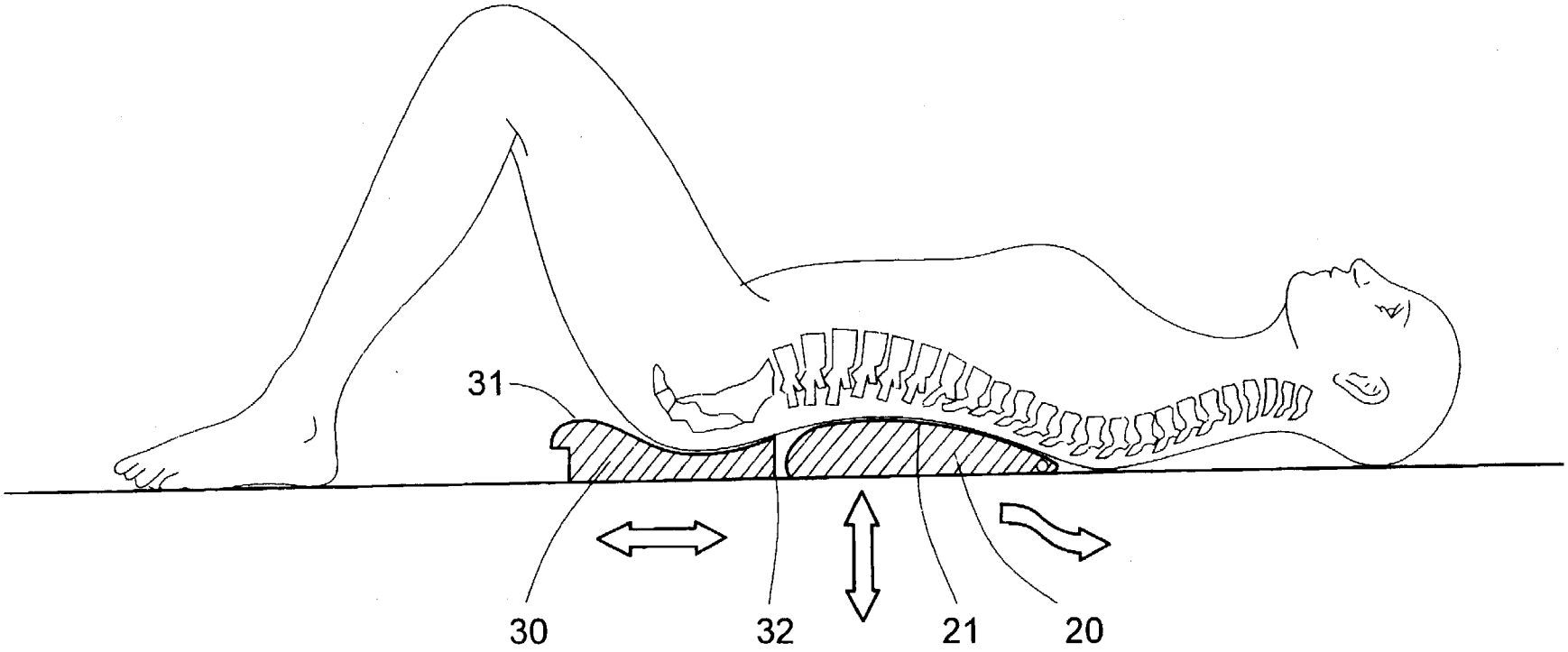
FIG. 9 is a silhouette showing the relative positions of a person's spine to the hip- and back-rests at the initial and completion positions.
Figure 10:
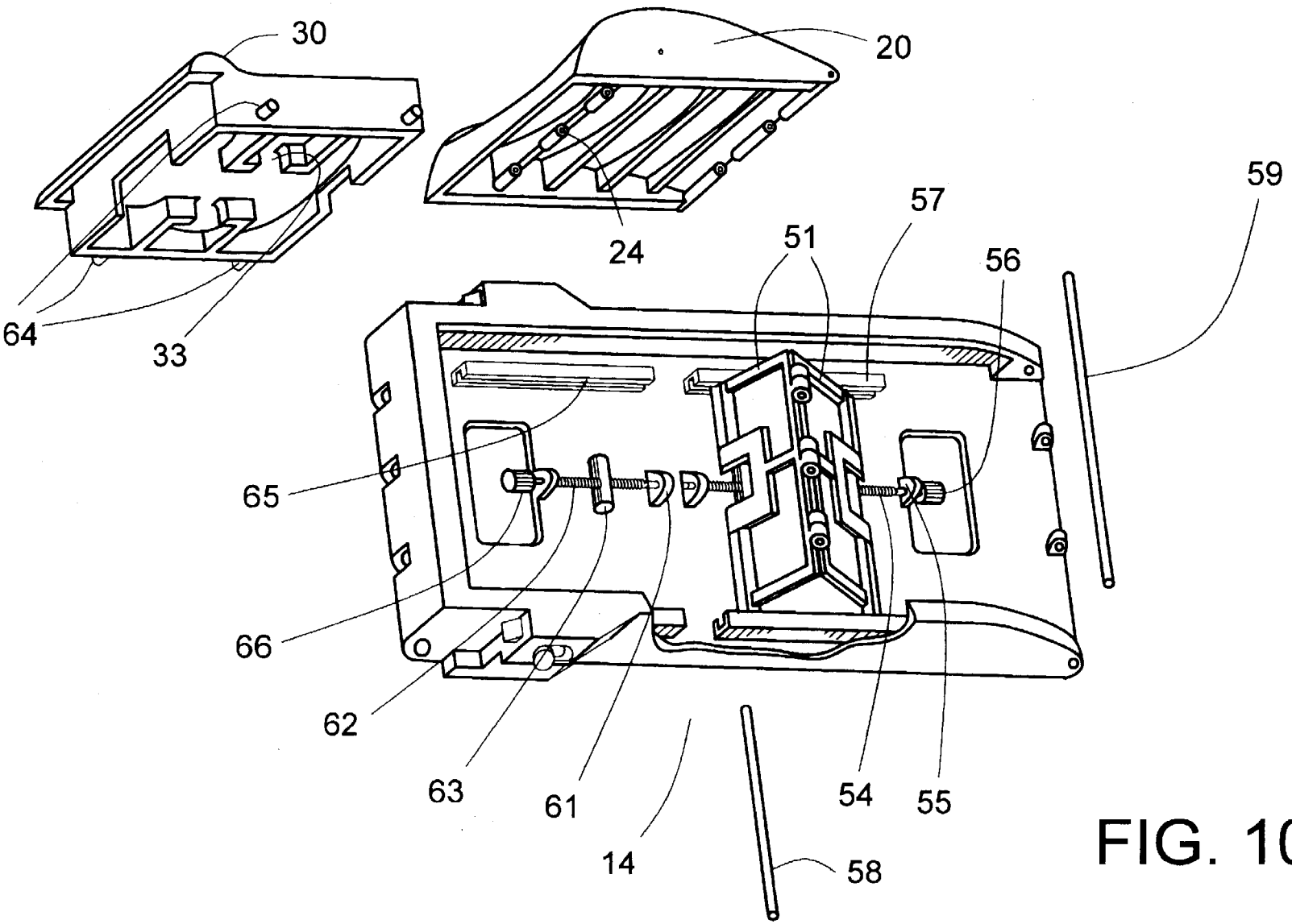
FIG. 10 is an exploded view showing the internal structure of the upper housing of the device of FIG. 1.
Figure 11:
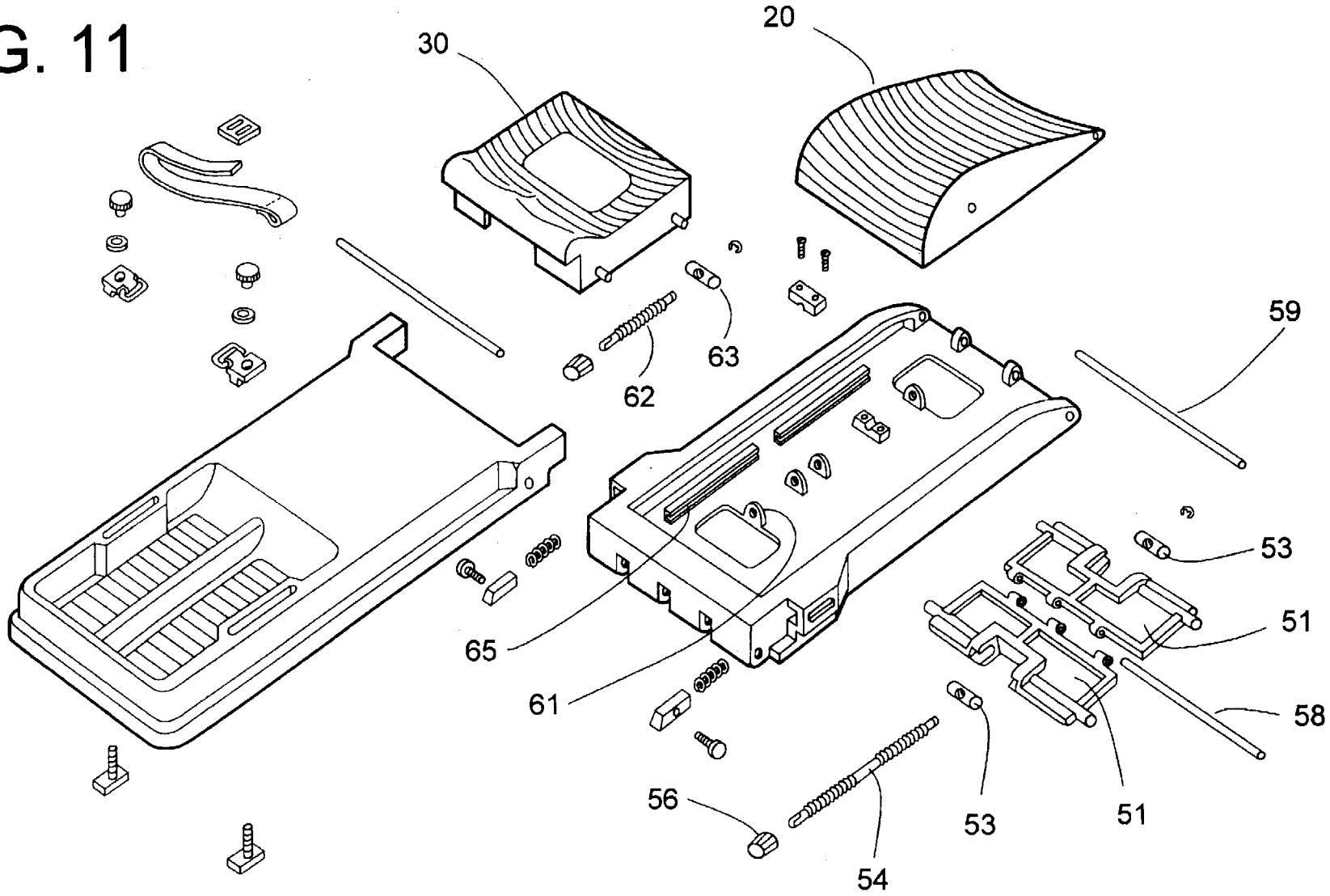
FIG. 11 is a further exploded view of FIG. 10 plus the lower housing.
Figure 12:
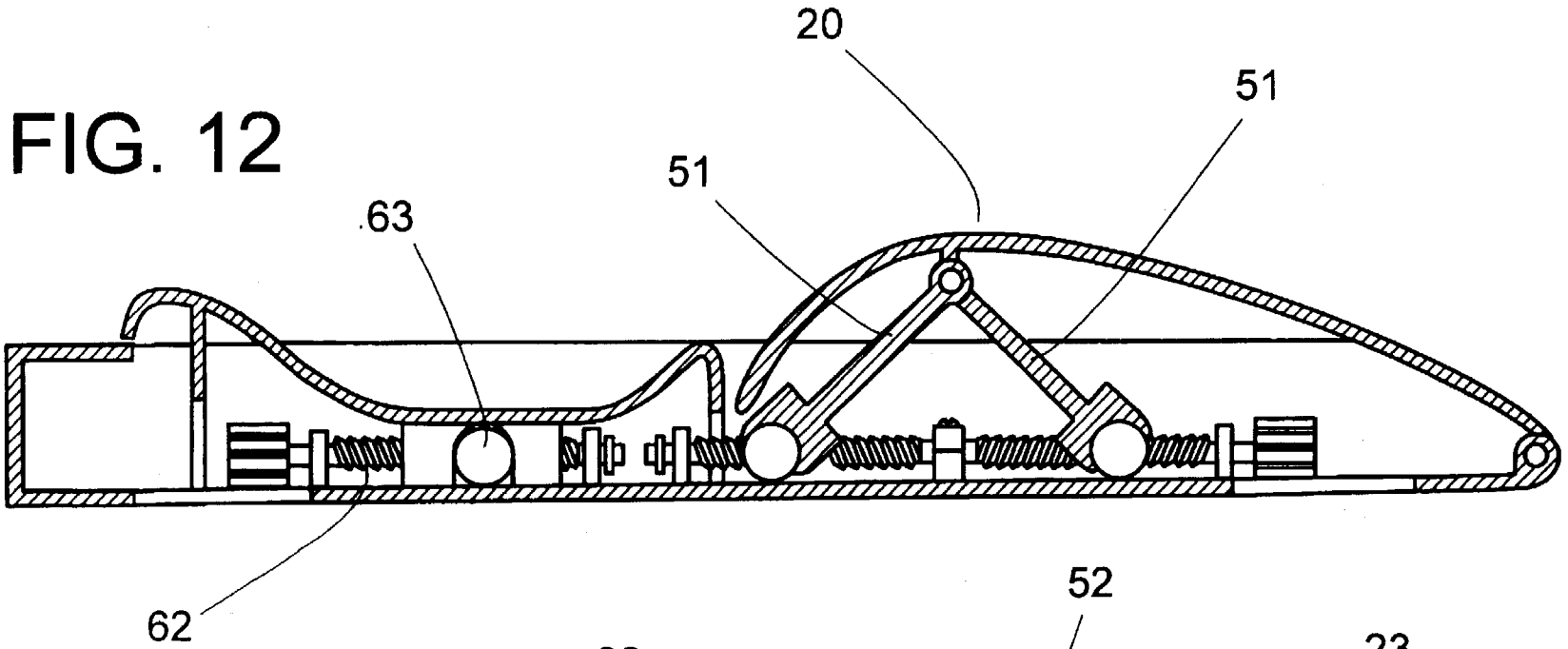
FIG. 12 is a cross-sectional view of the upper housing of the device of FIG. 1 showing the back-rests in a first alternate position.
Figure 13:
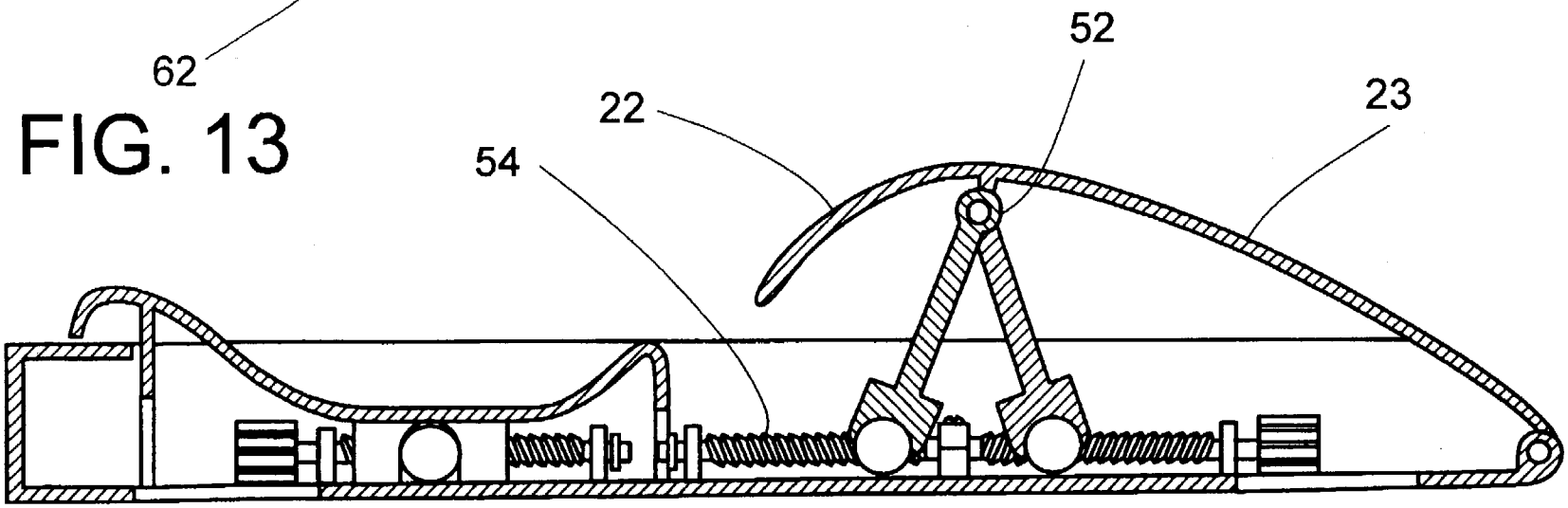
FIG. 13 is a cross-sectional view of the upper housing of the device of FIG. 1 showing the back-rests in a second alternate position.

The main housing 10 is substantially rectangular and comprises a first 11 and a second 12 end. It is made preferably of a light and rigid material such as aluminium, strong plastics or a combination thereof and comprises a lower 13 and an upper 14 housing which are of approximately equal lengths. The upper housing 14 receives the back- and hip- rests and are provided with adjustment means so that the longitudinal position of the hip-rest and the inclination of the back-rest 20 with respect to the upper housing 14 can be adjusted. The lower housing 13 accommodates the feet-rest 40 and provides connection to the upper housing 14. For better portability and user convenience, the upper and lower housing are hinged together at their respective end edges so that the device can be folded about the hinge into a back-to-back configuration, as shown in FIG. 3. When the device is fully expanded for use, a safety locking mechanism comprising for example a pin 15 and socket 16 set is provided on both sides to prevent undesirable accidental folding of the device which may cause injuries.

The back-rest 20 is for supporting the back of a user during the initiation and completion of exercise and comprises an upward arch 21 which is pivotably movable about the aforementioned first end 11 of the upper housing 14. The arch 21 is formed by the combination of a first and a second slope, each of which curves convexly outwards along the longitudinal direction of the housing frame. Preferably the arch 21 is non-symmetrical about the intersection of the slopes and comprises a steeper and shorter first slope 22 and a gentler and longer second slope 23. When a person lies naturally on the back-rest 20, the lumbar and dorsal spines are supported by the gentler slope which descends gradually to near ground level so that the head and shoulders of the user practically rests at ground level. Preferably the combined slope has a curvature resembling approximately that formed along the dorsal and lumbar spine of a fully developed human body for a good effect. To provide for better accommodation of the back, the back-rest 20 is also curved concavely downwards along the transversal direction of the housing.

The hip-rest 30 comprises a front 31 and a rear 32 edge and is slidably movable along and within the lower housing 13 frame between the back- and the feet- rest. It is substantially flat with a rounded and raised barrier at the front edge for comfortably restraining the forward displacements of the hips which may be caused by the forward inertia generated during exercise. A ridge is preferably provided near the middle of the barrier and extends slightly backwards towards the back-rest 20 so that the user's hips can be positioned easily.

The feet-rest 40 is formed as a recess near the front end of the lower housing 13 for receiving the user's feet. A flexible strap 41, using for example leather, Velcro (RTM) or other suitable flexible materials, mounted onto a pair of positioning means is provided to restrain the feet of the user for those who so prefer. The longitudinal position of the strap 41 is adjustable along a rail provided on the sides of the feet-rest 40 by means of a positioning means 42, such as a pair of locking pins or screws, so that persons with different leg lengths can be accommodated. A ridge is also formed near the middle of the recess for better positioning of the feet. Naturally, it shall be appreciated that the device, in the present or other embodiments, is substantially symmetrical about the longitudinal centre-line of the housing to match with such symmetry of a normal human body. It should also be appreciated that, while the present embodiment includes a lower housing 13 and feet-rest 40, such parts can be eliminated for a user who prefers not to have the feet restrained for performing modified versions of sit-up exercise.

U.S. Pat. No. 4,752,067 mentioned that the generally expert accepted normal lumbosacral angle is around 35 to 40 degrees when a person is in the supine neutral position. However, the size and depth of the arch 21 formed by the lumbar and dorsal spine of a person would not be universal and, as mentioned before, are dependent on the physical particulars of the user.

The device in the present invention is highly flexible and adjustable since, by adjusting according to his own physical particulars the relative positions of the back-, hip- and feet-rests, a user can always find the most suitable and comfortable configuration for exercise or relaxation.

In the present embodiment, there is provided a back-rest 20 which is hinged near the lower edge of its gentler slope to the first end 11 edge of the upper housing 14 so that it is pivotally movable thereabout. A height adjustment means is located directly underneath the back-rest 20 to cause pivotal movement about the hinge, thereby altering the height and the slope inclinations of the back-rest 20 with respect to the ground. Furthermore, there are also provided a hip-rest 30 and a feet-strap 41 the longitudinal position of which are adjustable. The elevation and positioning mechanisms which are utilised to fulfil the adjustability requirements will now be described.

Referring to FIG. 10 to 13, there is shown an exploded view of the upper housing 14 showing an inverted V-shape leg-pair 51 which is hinged at its vertex 52 and engaged via a pair of threaded collars 53 to a height adjustment shaft 54. The height adjustment shaft 54 has two sets of identical but opposite threads along part of its length and is supported at its unthreaded regions by a plurality of brackets 55 along the longitudinal axis of symmetry of the upper housing 14. An adjustment knob 56 is provided at one end of the shaft and is accessible from the outside through an opening for shaft turning. The collars 53 are formed by having a threaded opening formed transversally and centrally through a cylindrical rod and are retained within a recess formed on each leg 51. The threaded portions of the shaft 54 are allowed to advance or retreat transversally through the collars 53 according to the turning direction of the shaft 54 which is controlled by an adjustment knob 56.

A pair of guiding rails 57 are formed along the sides of the housing so that when the threaded shaft rotates, the opposite threads on the shaft 54 cause the V-opening of the legs to open or close, thereby altering the height of the vertex 52 of the inverted V-legs. As shown in the figure, the pre-moulded back-rest 20 is locked to the vertex of the elevation mechanism by the hinge shaft 58 which also passes through collars 24 formed underneath the back-rest 20. The change of vertex height thus causes the back-rest 20 to move pivotally about the hinge 59, thereby altering the height and slopes of the back-rest 20 to fit under a user's back.

The hip-rest 30 positioning mechanism is mounted on a plurality of brackets 61 and comprises a threaded shaft 62 which shaft is mounted at its unthreaded ends on the housing. A threaded collar 63 of the aforementioned type is mounted and is engaged to a recess 33 formed underneath the hip-rest 30. On the lower sides of the hip-rest 30 there are provided a plurality of transversally protruding lugs 64 which are slidably movable along a pair of rails 65 formed along the sides of the upper housing 14. A position adjustment knob 66 accessible through a bottom opening of the housing is provided at one end of the shaft 62 so that when the knob 66 is turned, the hip-rest 30 moves according to the longitudinal movement of the collar 63.

Referring to FIGS. 14 to 16, there is shown a second embodiment of the present invention in which the device comprises a hip- and back-rests which are connected together by a pair of straps 71. The distance between the hip- and back-rests is adjustable by the length of the straps 71 which is maintained by buckles. The back-rest 20 is mounted on an inflatable box-base 72. The slope of the back-rest 20 is controlled pneumatically by the inflatable-box 72 which has a fan-shaped cross section and has a fixed 73 and an expandable end 74. The inflatable box 72 comprises a plurality of V-shaped foldable creases so that the width of its expandable end, which represents the pivotal displacement of its top edge about the fixed end 73, depends on the air-pressure inside the box. Further fine adjustment can be achieved by utilising an inflatable back-rest 20. It should however be noted that an non-inflatable rigid back-rest 20 in combination with an inflatable base-box would appreciably provide the same degree of adjustability as the first embodiment. It should also be noted that an adjustable base having a fixed end and an expandable end the width of which can be adjusted and maintained by other mechanical means can replace an inflatable base.

Figure 17:
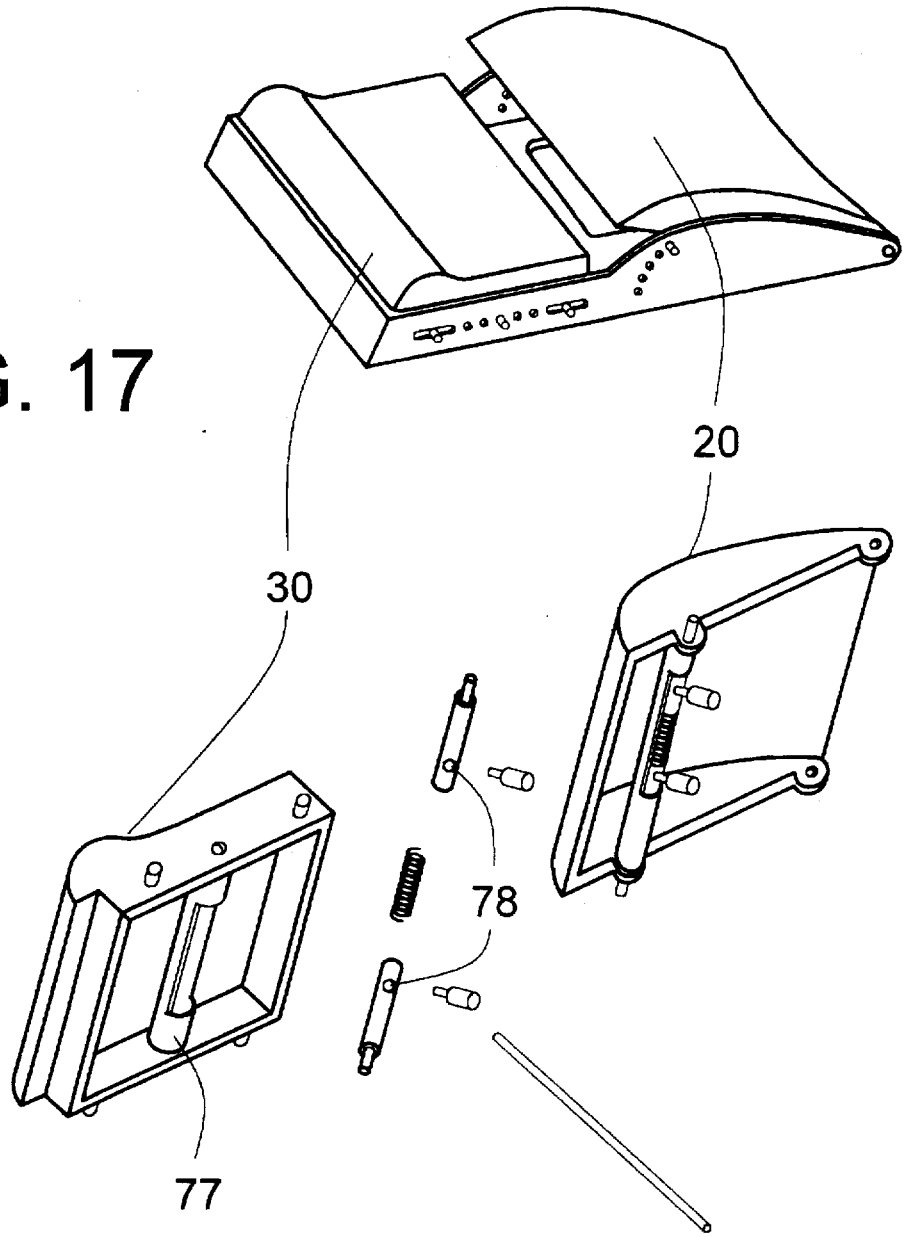
FIG. 17 shows the top perspective view of a third embodiment of the present invention.
Figure 18:
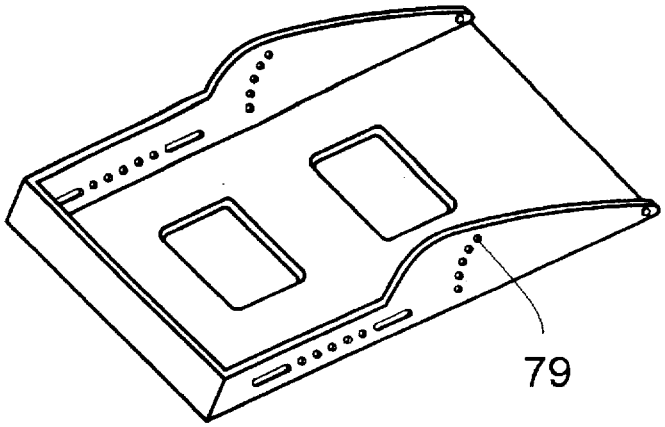
FIG. 18 shows the partly exploded view of the device of FIG. 17.

Referring to FIGS. 17 and 18, there is shown a third embodiment of the present which comprises a main housing, a hip-rest 30 and a back-rest 20. Similar to the first embodiment, the back-rest 20 is hinged at one end to the main housing near the ground level. A pair of brackets 77 are formed underneath the back-rest 20 near its un-pivoted front edge through which brackets a pair of spring biased pins 78 pass together. The slopes of the back-rest 20 are adjustable by engaging the shaft into holes 79 located on the sides of the housing which holes are arranged according to the positions corresponding to the locus of pivotal movement of the pins about the hinge. To release and relock the shaft from a locked position, a user can access the shaft from the bottom access and release the shaft by pushing the two retractable pins towards each other and then releasing and putting the pins into at the desired holes. The hip-rest 30 is provided with a plurality of protruding lugs which enable it to be slidable along a plurality of elongated parallel slots formed on the sides of the housing. Its position along the slots is defined by a plurality of positioning holes formed on the side of the housing, thus varying the distance between the hip- and back-rest 20.

Figure 19:
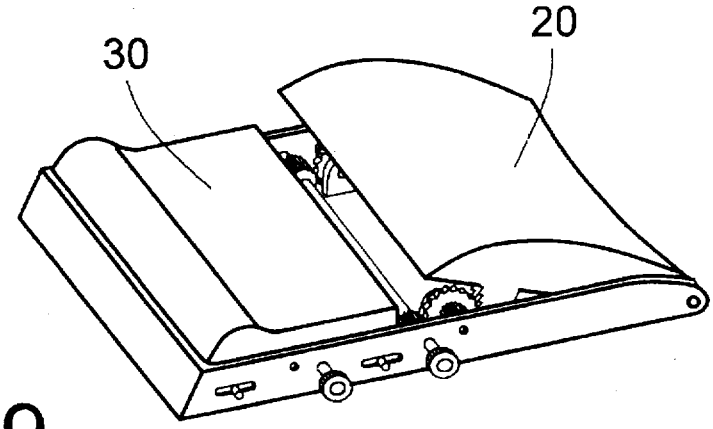
FIG. 19 shows the top perspective view of a fourth embodiment of the present invention.
Figure 20:
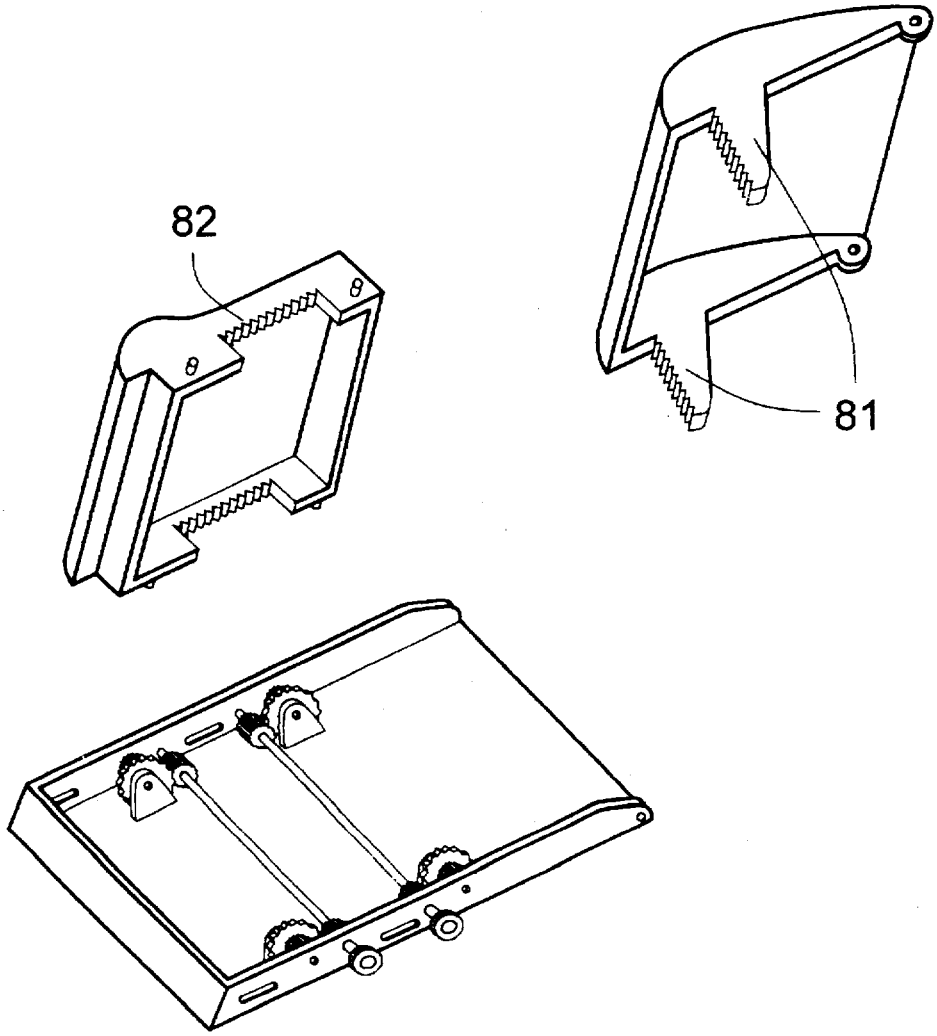
FIG. 20 shows the exploded view of the device of FIG. 19.

Referring to FIGS. 19 and 20, there is shown a fourth embodiment of the present invention in which the device also comprises a main housing, a hip-rest 30 and a back-rest 20. The slopes of the back-rest 20 are adjusted by a rack and pinion gear set in which the racks are formed on a pair of curved arms 81 which protrude downwardly from the underside of the back-rest 20 near the non-pivoted end. A pair of cog and pinion assemblies are mounted on the insides of the main housing corresponding to the positions of the racks for engagement and slope adjustment. The hip-rest 30 is provided with a plurality of transversally protruding lugs on the sides which enable it to be slidable along a plurality of elongated parallel slots formed on the sides of the housing. A pair of racks 82 are provided along the top edges of recesses which are formed on the sides of the hip-rest 30 so that its longitudinal position can be adjusted by a pair of corresponding pinion assemblies mounted on the main housing.

Figure 21:
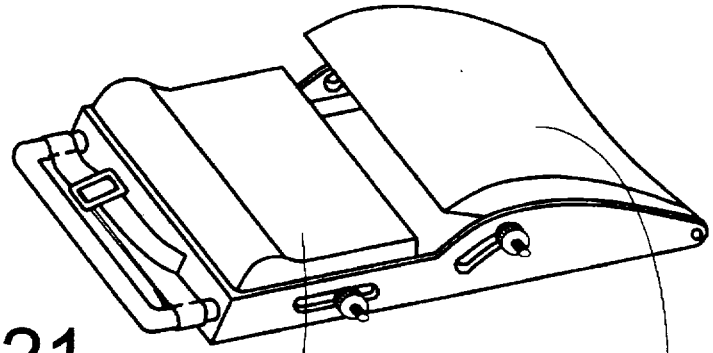
FIG. 21 shows the top perspective view of a fifth embodiment of the present invention.
Figure 22:
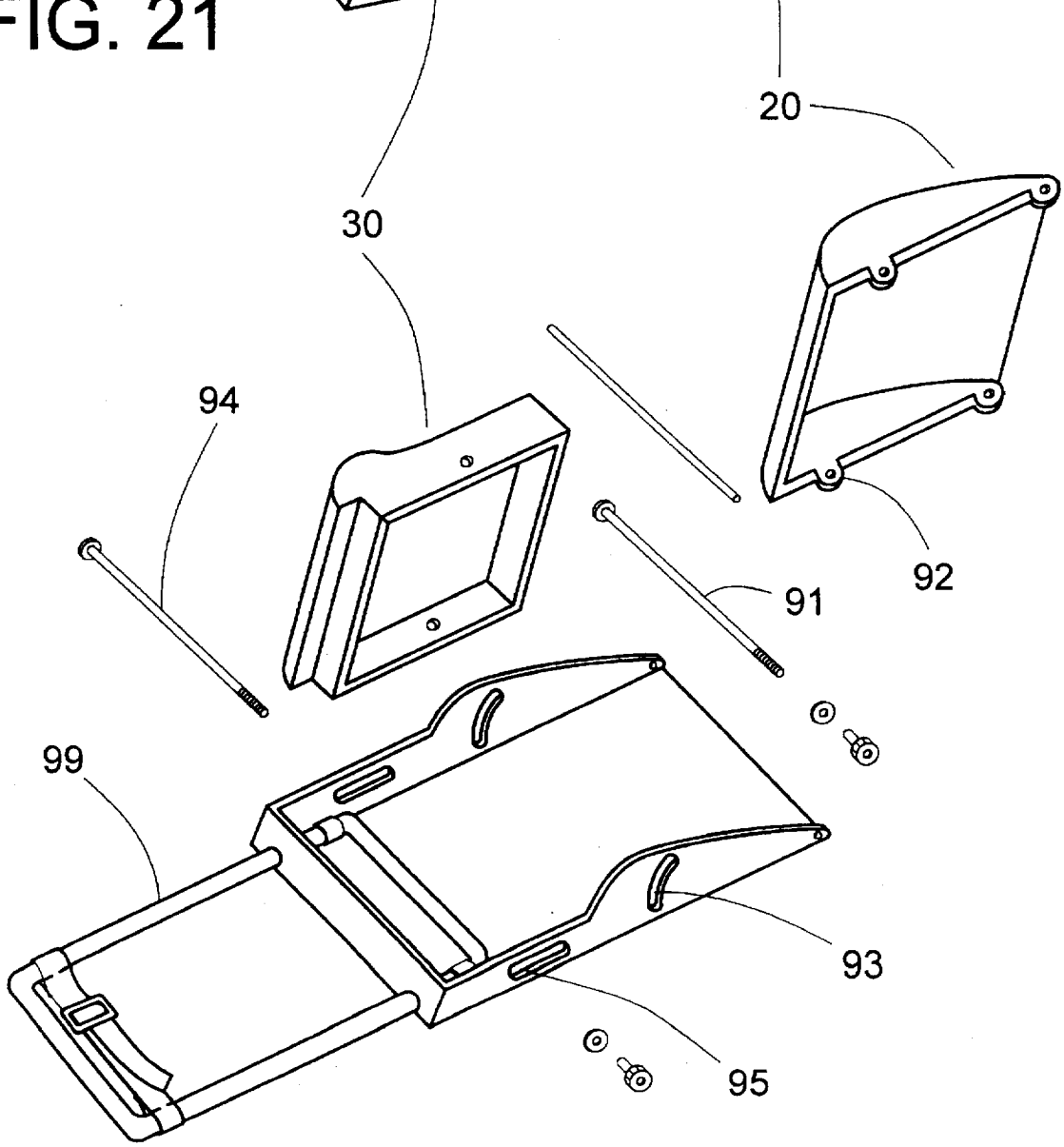
FIG. 22 shows the partly exploded view of the device of FIG. 21.

A fifth and the final embodiment of the present invention is shown in FIGS. 21 and 22 in which the device comprises a main housing, a hip-rest 30, a back-rest 20 and a retractable feet restraint. The back-rest 20 has an edge pivoted to the main housing and its slopes are adjusted by changing the position of a long screw 91 which passes through a pair of brackets 92 formed on the underside of the back-rest 20 and a pair of curved slots 93 formed on the sides of the main housing. The slopes are then maintained by tightening the screw 91 from one end against the side walls of the housing. The longitudinal position of the hip-rest 30 is adjusted and maintained by another long screw 94 which passes through both side walls 95 of the main housing. In this embodiment, there is further provided a feet restraint 99, formed preferably by a rectangular frame of hollow aluminium pipes or moulded plastic, which can be retreated also completely inside the main housing when not required.

While the present invention has been explained with reference to a plurality of preferred embodiments, it should be appreciated that the scope of the invention should not be limited to these embodiments. At least, it should be appreciated that the various mechanisms described in the embodiments can be combined, interchanged or re-arranged without loss of generality or functionality.

I claim:

1. An exercise device comprising a housing, a hip-rest and a back-rest wherein:

said housing comprises a first end and a second end;

said hip-rest and back-rest are mounted on said housing;

said back-rest is for supporting the back of a user during the initiation and completion of exercise and comprises an upward arch which is pivotably movable about said first end of said housing; and said hip-rest is for receiving the hips of the user during the exercise and comprises a front and a rear edge wherein the longitudinal distance between said front edge of the hip-rest and said first end of said housing is adjustable, and a raised barrier at said front edge of said hip-rest for restraining the hips of the user.

2. An exercise device comprising a housing, a hip-rest and a back-rest wherein:

said housing comprises a first end and a second end;

said hip-rest and back-rest are mounted on said housing;

said back-rest is for supporting the back of a user during the initiation and completion of exercise and comprises an upward arch which is pivotably movable about said first end of said housing;

said arch of said back-rest comprises a first and second slope;

said first slope is shorter and steeper than said second slope; and said second slope faces said first end of said housing and the lower end of said second slope descends substantially to the ground level such that, in combination with the longitudinal position adjustment of said hip-rest, the shoulders of the user are practically resting on the ground level; and said hip-rest is for receiving the hips of the user during the exercise and comprises a front and a rear edge wherein the longitudinal distance between said front edge of the hip-rest and said first end of said housing is adjustable.

3. An exercise device comprising a housing, a hip-rest and a back-rest wherein:

said housing comprises an upper housing and a lower housing having a first end and a second end;

said hip-rest and said back-rest are mounted on said upper housing; and said lower housing is provided with a foot-rest, wherein said foot-rest is provided with means for restraining the feet of the user;

said back-rest is for supporting the back of a user during the initiation and completion of exercise and comprises an upward arch which is pivotably movable about said first end of said housing; and said hip-rest is for receiving the hips of the user during the exercise and comprises a front and a rear edge wherein the longitudinal distance between said front edge of the hip-rest and said first end of said housing is adjustable.

4. An exercise device according to claim 3, wherein the longitudinal position of said means for restraining the feet is adjustable.

5. An exercise device according to claim 3, wherein said upper and lower housing are hinged together such that said upper and lower housing can be folded into a back-to-back configuration.

6. An exercise device according to claim 3, wherein:

said lower housing can substantially be retractable within said upper housing.

7. An exercise device according to claim 3, wherein a raised barrier is formed at said front edge of said hip-rest for restraining the hips of the user.

8. An exercise device according to claim 3, wherein:

said arch of said back-rest comprises a first and a second slope;

said first slope is shorter and steeper than said second slope; and said second slope faces said first end of said housing and the lower end of said second slope descends substantially to the ground level such that, in combination with the longitudal position adjustment of said hip-rest, the shoulders of the user are practically resting on the ground level.

9. An exercise device comprising a housing, a hip-rest and a back-rest wherein:

said housing comprises a first end and a second end:

said hip-rest and back-rest are mounted on said housing;

said back-rest is for supporting the back of a user during the initiation and completion of exercise and comprises an upward arch which is pivotably movable about said first end of said housing;

wherein pivotal movement of said back-rest about said first end of said housing is caused by a height adjustment means, and wherein:

said height adjustment means comprises a height adjustment shaft and an inverted V-shaped leg pair;

said shaft comprises two sets of identical but opposite threads along part of its length and is supported at its unthreaded regions by a plurality of brackets along the longitudinal axis of symmetry of said housing; and said inverted leg pair is hinged at its vertex, slidably movable within said housing and is engaged to the oppositely threaded portions of said height adjustment shaft: and said hip-rest is for receiving the hips of the user during the exercise and comprises a front and a rear edge wherein the longitudinal distance between said front edge of the hip-rest and said first end of said housing is adjustable.

10. An exercise device according to claim 1, wherein the longitudinal position of said hip-rest within said housing is adjustable by a positioning mechanism, and wherein:

said positioning mechanism comprises a threaded shaft, a threaded collar and a recess formed underneath said hip-rest;

said threaded shaft is mounted at its unthreaded ends on a plurality of brackets;

said threaded collar is movable along the threads of said threaded shaft when said shaft is being rotated; and said threaded collar is engageable with said recess formed underneath said hip-rest.

* * * * *